United States Patent [19]

Paloian et al.

[11] 4,362,925

[45] Dec. 7, 1982

[54] VOTING MACHINE

[75] Inventors: Michael D. Paloian, Babylon; Peter D. George, Mount Sinai, both of N.Y.

[73] Assignee: Ransom F. Shoup & Company, Inc., Bryn Mawr, Pa.

[21] Appl. No.: 299,015

[22] Filed: Sep. 3, 1981

[51] Int. Cl.[3] ..... G07C 13/00

[52] U.S. Cl. ..... 235/51; 235/54 R

[58] Field of Search ..... 235/51, 54 R, 54 A, 235/54 C, 54 D, 55 R, 55 A, 55 C

[56] References Cited

U.S. PATENT DOCUMENTS 2,550,950 5/1951 Young ..... 235/51

3,790,072 2/1974 Moldovan, Jr. ..... 235/54 R X

*Primary Examiner*—L. T. Hix

*Assistant Examiner*—Thomas H. Tarcza

*Attorney, Agent, or Firm*—Woodcock, Washburn, Kurtz, Mackiewicz & Norris

[57] ABSTRACT

An improved voting machine particularly suitable for use in harsh environments is disclosed which features a control box which is operated by an election official individually activating the machine before each vote is cast. The control box may be disposed at a distance from the voting machine and is connected thereto by a permanently attached flexible cable, whereby the machine is rendered essentially foolproof yet durable in service. The machine is provided with first locking means to enable viewing of the tallies on the vote counters and second locking means prohibiting resetting of the counters except by authorized persons. A counter is also provided to provide a count of the number of times the tallies are reset to zero.

3 Claims, 4 Drawing Figures

VOTING MACHINE

FIELD OF THE INVENTION

This invention relates to the field of voting machines. More particularly, this invention relates to voting machines of the type in which votes are recorded on a counter incremented by one for each vote by a voter desiring to vote for a particular political candidate.

BACKGROUND AND OBJECTS OF THE INVENTION

This invention relates to voting machines primarily for use in less developed countries where voting machines must be rugged, simple and reliable, able to continue their function under adverse circumstances, yet preserving secrecy of balloting and security of the vote essential to proper functioning of the electoral system. Prior art voting machines are in general too complicated and expensive for use in such service. Moreover, it is also important that a voting machine be provided which does not require electrical power to operate and one which is sufficiently durable to be substantially tamper-proof so as to prevent ballots to be recorded at a first location and the entire machine bodily carried back to a central election board for totalization of results without fear of unauthorized tampering with the results. In accordance with usual practice it is an important object of the invention to provide a voting machine capable of satisfying the above requirements while preserving the capability of limiting the number of ballots cast for a particular office by a single voter.

Another important object of the voting machine of the invention is that means must be provided whereby it can be confirmed that the vote counters read zero at the beginning of a day's voting while not exposing the counters to the voters during the election process.

Another object of the present invention is to provide a voting machine which provides a non-resettable counter which counts the number of times the voting machine case is opened whereby security can be assured.

Another object of the invention is to provide means whereby an election official can maintain control over a machine, e.g., resetting it to be available for voting after each individual voter, without requiring him to be in close juxtaposition with the voter, so that privacy of the vote is assured.

SUMMARY OF THE INVENTION

The above needs of the art and objects of the invention are met by the present invention which comprises a voting machine having mechanical vote counters individually actuated by a voter simply pressing a button. Upon pressing of the button a mechanical latch is set preventing further voting for an incorrect number of candidates for a given office. The voting machinery is then reset by the poll official to allow the next voter to vote. Relatively movable opaque panels with windows formed therein are provided which can be aligned to permit the poll officials to confirm that the counters read zero at the beginning of a given election day. The windows are thereafter moved out of alignment with one another so that the voters do not see the poll count as it goes on.

The machine is so constructed that a lockable panel prevents access to the means for resetting the counters to zero so that security of the vote is assured, and a control box is provided which is connected to the election machine by a so-called Morse cable, i.e., one in which a wire slides within a flexible sheath, to allow a poll official to reset the machine after each voter has finished.

BRIEF DESCRIPTION OF THE DRAWINGS

The invention will be better understood if reference is made to the accompanying drawings, in which.

DESCRIPTION OF THE PREFERRED EMBODIMENTS

Figure 1:
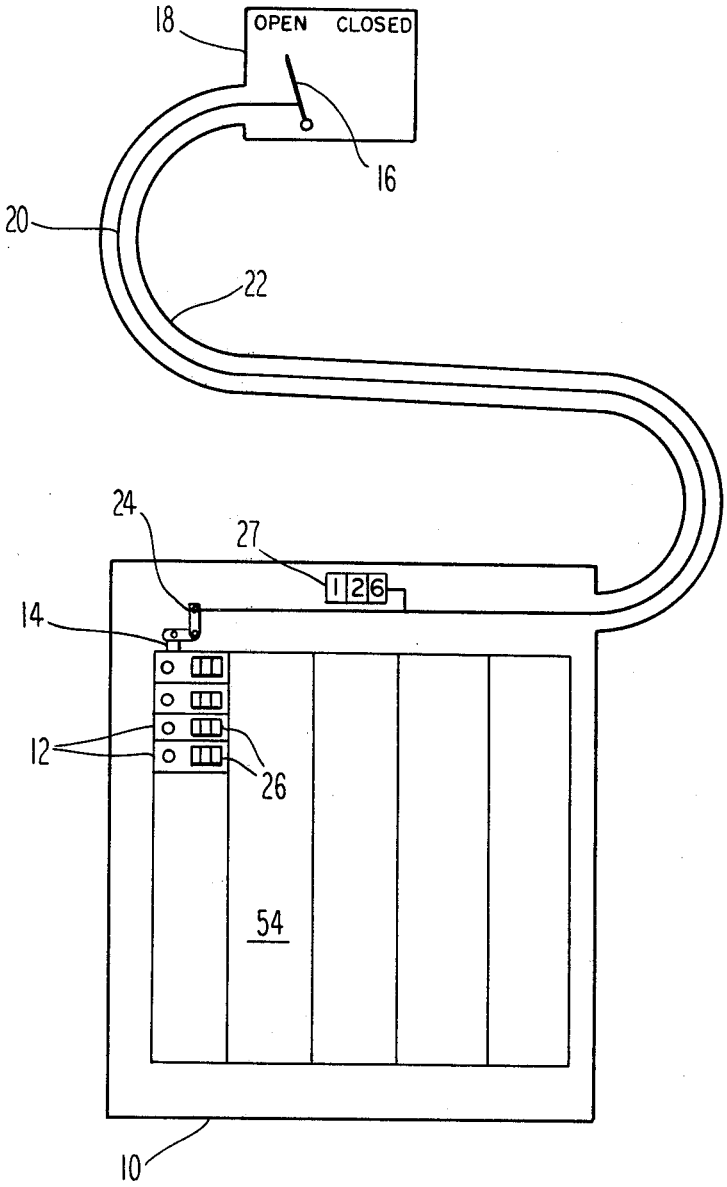
FIG. 1 shows an overall view of the voting machine of the invention, the control box and the interconnecting cable.

FIG. 1 shows an overall view of the voting machine according to the invention in which a first portion 10 is provided with a plurality of buttons 12 which are depressed by a voter in order to select the candidate of his/her choice. In a presently preferred embodiment of the invention, the machine is arranged so that only a single candidate for any office can be selected by a voter. Accordingly, upon depressing of a button by the voter it is desirable that no other buttons be capable of being depressed. An interlock 14 is thus energized upon the depressing of any one of the buttons 12. When that voter leaves the booth and it is desired that the machine be reset to allow a second voter to vote, a pivoting control lever 16 carried on a control box 18 is moved to the "Open" position which pulls a flexible wire cable running within a flexible sheath 22, which in turn actuates a pivoting bell crank 24, which in a manner to be described in detail below, resets the interlock 14 to permit a subsequent voter to vote. Upon the voter's pressing the voting button 12, a counter indicated generally at 26 is incremented by one. The counters 26 are shown in FIG. 1 to give an idea of their general location, although means are provided whereby the voter is not permitted to see the actual count. A voter counter 27 is also actuated once per voter, e.g., by operative connection to the wire 20, to provide a count of the total number of voters.

Figure 2:
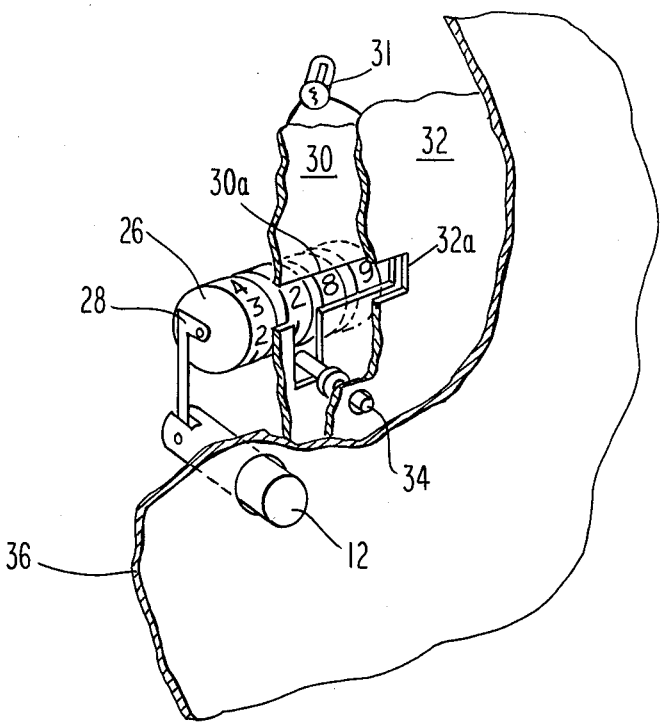
FIG. 2 shows a perspective cutaway view of a portion of the counter mechanism of the voting machine of the invention.

FIG. 2 shows a perspective sketch of a typical arrangement of the counter 26 and voting button 12. The voting button 12 operates through a lever 28 to increment the counter 26 in a well known manner. The counter may be a widely available item, for example, one suitable for use in a presently preferred embodiment of the invention is made by Veeder-Root and bears their model No. 743614004. The counter 26 is disposed behind two opaque plates 30 and 32 which are provided with windows indicated at 30*a* and 32*a*, respectively. When the two windows are aligned, as shown in FIG. 2, one can read the total number of votes cast on the counter 26. However, the plate 30 is arranged to be movable relative to the plate 32 so as to misalign the windows 30*a* and 32*a* and prevent the voter from seeing the total counted. Accordingly, the poll official, for example on the morning of the election, can move the plate 30 with respect to plate 32 in order to align the windows 30*a* and 32*a* to confirm that the counter is at zero. He can then move the plate 30 so as to set the windows out of alignment obscuring the counter 26 and lock the plate 30 with respect to plate 32 by means of a lock shown schematically at 31, for the day's voting.

Resetting of the counter at the end of an election is accomplished by depressing the reset button 34. This, as well is not available to be touched by the voter as it is disposed behind an additional sheet 36. This sheet 36 may, in a preferred embodiment, be made of a transparent plastic so that the buttons can be observed and the counters read, as above, while only the voting button 12 actually protrudes through the face of the voting machine 36.

Figure 3:
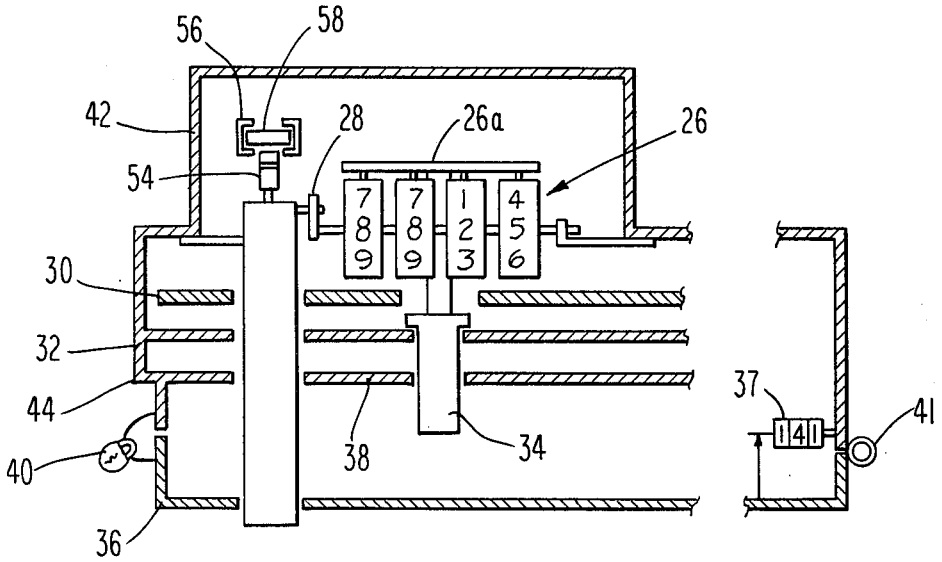
FIG. 3 shows a plan view of the counter mechanism of the voting machine of the invention.

FIG. 3 shows a cross-sectional view of the voting apparatus according to the invention. The voting button 12 is shown operatively connected by means of linkage 28 to a counter 26 which, as noted above, may be a conventional item. This is provided with a reset mechanism 26*a* activated by a reset button 34 which protrudes through a first plastic sheet 38 typically transparent. Resetting of the counter 26 by means of depressing the button 34 may only be accomplished by opening the outer transparent sheet 36 which may be hinged to the case 42 of the machine at 41 and closed by means of a lock 40 so that only appropriate election officials can reset the counter to zero. A counter 37 is provided on the hinged outer sheet 36. Counter 37 is operatively connected between the hinged cover 36 and the back portion of the machine 42, e.g., at the hinge 41, such that every time the machine is opened to reset the counter to zero, the counter is incremented by one, so that in the event of a questioned election, the number of times the machine has been opened can be compared with the official machine maintenance records so that the security of the voting process can be assured. Accordingly, for example, the voting machines would be set to zero, locked by lock 40 and shipped to a remote location for voting. When the voting is completed the count can be read at the remote location by an election official provided with a key appropriate to allow unlocking of the lock 31 (FIG. 2) controlling the relative positions of plates 30 and 32 by alignment of the windows 30*a* and 32*a*, but the counters 26 cannot be reset to zero until a second official having a key to the lock 40 is permitted to open the panel 36 and reset the counters 26 by depressing the reset button 34.

Preferably, the entire mechanism is disposed in a sealed container comprising a back wall or case indicated schematically at 42 which is sealed to the front panel 44 such that only qualified manufacturers' representatives are able to open the machine for adjustments. In this way tampering with the machine by venal officials can be substantially eliminated. In a preferred embodiment, the entire back case of the voting machine of the invention is molded of plastic and is provided with metallic inserts for appropriately durable mounting of the counters and associated mechanisms.

As noted above, it is important in the control of elections by poll officials that an individual voter be permitted to vote once and only once for each given office. Moreover, it is desirable that a positive act be required of the election official before a second voter can vote, so as to ensure that the first has left the booth. In the present case it was furthermore desirable that such control be accomplished entirely by mechanical means, i.e., not requiring any electrical power, batteries or the like, and be done such that a poll official could remain at some distance from the voting machine to give the voter a modicum of privacy. Furthermore, it was desirable that the control means be permanently connected to the voting machine itself so as to render the operation of the machine more nearly foolproof, yet without making the machine unduly cumbersome. This is accomplished according to the present invention by providing the arrangement shown above in connection with FIG. 1 in which a control panel 18 is connected to the voting machine 10 by a flexible cable sheath 22 of fixed length having a wire 20 running through the center thereof so as to enable the poll official to "open the polls" to admit a voter. The poll is thereafter "closed" by the voter's voting, thus requiring a reopening of the poll for each succeeding voter. Provision of the control panel and flexible cable has several advantages. The control panel need not be disposed at any particular location with respect to the voting machine but can be arranged to suit the poll operator's convenience. The cable and control can be stored within the back of the machine within a recess (not shown) provided for the purpose of convenience, while use of the flexible cable allows the connections between the control panel, flexible cable and voting machine to be permanently made at the place of manufacture of the voting machine, thus rendering it substantially foolproof in service.

Figure 4:
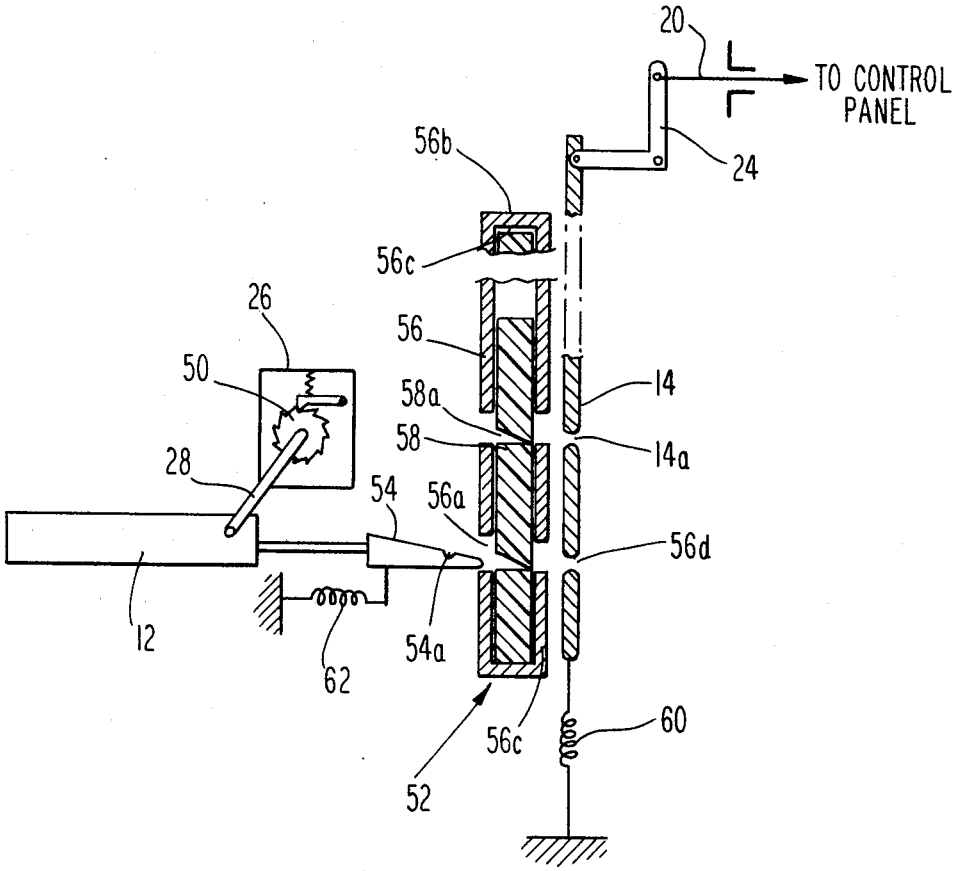
FIG. 4 shows the interlock mechanism of the voting machine according to the invention.

FIG. 4 shows details of the interlock mechanism which prevents the voter from voting for too many candidates for any one office and also shows the means whereby the poll official is provided with a method of resetting the machine to "open the pools" for each successive voter. FIG. 4 shows a first counter 26 adapted to be incremented by the depressing of a voting button 12 operating through a lever 28 operating generally by means of, for example, a ratchet-and-pawl mechanism indicated generally at 50 so that the counter is incremented only upon the pressing of the button, i.e., rightward in FIG. 4, and not upon its release. A plurality of such counters 26 and the voting buttons 12 are provided for each office, arranged in a vertical array, and connected to an interlock mechanism indicated generally at 52 such that the number of votes a voter can cast for any one office can be controlled. In a particularly preferred embodiment of the machine shown in FIG. 1, up to 15 counters 26 and activating buttons 12 are arranged in each of 5 columns. By opening shutters indicated generally at 54 to expose the appropriate number of buttons, the number of buttons exposed is made equal to the number of candidates for the particular office. Thus, while only one counter 26 and voting button 12 are shown in FIG. 4 it will be understood that a plurality of such counters are provided and that a number equal to the number of candidates for any particular office is exposed to the voting public at any one time.

Thus, upon depressing of the voting button 12 by a voter an interlocking tongue 54 passes through a hole 56*a* formed in a channel 56 carrying a plurality of keys 58 such that the tongue 54 is forced between the keys 58. The keys 58 may be formed of an antifriction material for smooth operation; beveled under surfaces 58*a* are provided on the lower surfaces of the keys 58. The keys 58 are confined in the channel 56 by top and bottom portions 56*b* and 56*c*, respectively, such that only a limited amount of clearance is present in the overall channel; that is, the distance between the top and bottom 56*b* is equal to the total length of the keys 58 plus a small clearance, e.g., 0.060", as shown at 56*c*. In the single vote per office embodiment of the invention, each tongue 54 is sized such that when a tongue 54 passes through the apertures 56*a* in the channel 56 and passes between the keys 58 it takes up this clearance such that no other tongue 54 can similarly pass through any other of the apertures 56*a*. This prevents more than one voting button 12 from being depressed. It will, of course, be appreciated that it if were desired to permit voting for two candidates for any given office, it would be a simple matter simply to vary the thickness of the tongues 54 so that, for example, two tongues 54 could be pressed into the space available 56*c* before all clearance was consumed.

After the tongue 54 has passed between the keys 58 it passes through a second aperture 56*d* in the channel and engages a locking member 14 which in a preferred embodiment is simply a vertically-movable strip of metal having holes 14*a* punched therein for interaction with grooves 54*a* formed on the upper surface of the tongues 54 such that when a tongue 54 passes through the aperture 14*a* in the locking member 14 it is raised upwardly against the bias of a spring 60 which causes the upper edge of the aperture 14*a* to rest in the notch 54*a* after the tongue 54 has passed sufficiently far through the aperture 14*a* in the locking member 14. In this way, the tongue 54 and accordingly the voting button 12 do not return to their initial position after voting, though they are biased thereto by a spring 62. Alternatively, the button 12 can be arranged to return to its initial position while leaving the tongue in the interlocked position. In either case, resetting of the machine can be accomplished only by a poll worker at the control box 18 (FIG. 1) moving the lever 16 past the "closed" and back to the "open" positions. Doing so causes lever 16 to first pull control wire 20 operating through the flexible cable 22, to rotate a bell crank 24 which in turn lifts the locking member 14 against the spring 60 allowing the spring 62 to pull the tongue 54 and voting button 12 back to their initial positions. Thereafter, release of the lever 16 will allow the spring 62 to pull the interlock bar 14 down and lever 16 to the "open" position. Similarly, raising of the locking bar 14 by the voter's pressing the button 12 causing the tongue to pass through the apertures 14*a* and the bar 14, will move the lever 16 to the "closed" position, thus indicating to the poll worker that the voter has voted. At this time a bell may also be rung indicating that voting has been accomplished and the counter 27 shown schematically in FIG. 1 for keeping track of the total number of votes recorded per office can be increment. As a further security measure counter 27 is resettable only by the manufacturer's representation by being sealed within the machine, as described above. The poll worker, after the proceding voter has left the booth and the poll worker has confirmed that the succeeding voter is duly registered, can reactivate the machine by then pulling the lever 16 further toward the "closed" position thus raising the bar 14 via the bell crank 24, as described above, and permitting the voting button 12 to be returned by spring 62 to its initial position.

It will be appreciated that there has been described a voting machine which fulfills the needs of the art and objects of the invention mentioned above. Provision of a control panel connected to the voting machine by means of a flexible cable allows the location of the control panel with respect to the machine to be chosen for reasons of convenience of the poll workers while the permanent connection renders the operation of the machine to be substantially foolproof. Providing all counters and actuating mechanisms within a lockable compartment provides good control of the security of the election process, while provision of counters for the total number of votes cast and for the number of times the machine is opened also assists in controlling the security of the election.

Furthermore, an interlock means has been described above which allows control of the number of voters voting for any one office, while requiring that the poll worker reset the machine to allow successive voters to vote, again assuring security of the voting process.

Finally, means have been described whereby only representatives of the manufacturer of the machine can obtain access to its contents thus further assuring the security of the voting process.

It will be appreciated that there are numerous additions and modifications that can be made to the machine of the invention as shown and described and that therefore the above description should be considered as exemplary only and not as a limitation on its scope which is more properly defined by the following claims.

We claim:

1. A voting machine of the type in which first locking means are provided to prevent resetting of counter means for counting the number of votes cast for a candidate except by authorized persons, additional counter means being provided to count the number of times said locking means are opened to permit said resetting, whereby security of said machine is enhanced.

2. The machine of claim 1 wherein additional locking means are provided to enable only authorized persons to view tallies produced on said counter means.

3. The machine of claim 2 wherein additional counter means are provided, being adapted to provide a tally of the total number of votes cast.

* * * * *